US008481132B2

(12) United States Patent
Simpson et al.

(10) Patent No.: US 8,481,132 B2
(45) Date of Patent: Jul. 9, 2013

(54) TRANSPARENT INK-JET RECORDING FILMS, COMPOSITIONS, AND METHODS

(75) Inventors: Sharon M. Simpson, Lake Elmo, MN (US); James B. Philip, Mahtomed, MN (US)

(73) Assignee: Carestream Health, Inc., Rochester, NY (US)

( * ) Notice: Subject to any disclaimer, the term of this patent is extended or adjusted under 35 U.S.C. 154(b) by 0 days.

(21) Appl. No.: 13/247,135

(22) Filed: Sep. 28, 2011

(65) Prior Publication Data

US 2012/0088044 A1 Apr. 12, 2012

Related U.S. Application Data

(60) Provisional application No. 61/391,255, filed on Oct. 8, 2010.

(51) Int. Cl.
*B41M 5/40* (2006.01)
*B41M 5/52* (2006.01)
*B41M 5/50* (2006.01)

(52) U.S. Cl.
CPC ..... *B41M 5/52* (2013.01); *B41M 5/5254* (2013.01); *B41M 5/506* (2013.01); *B41M 5/5218* (2013.01); *B41M 5/5236* (2013.01)
USPC ..... 428/32.13; 428/32.24; 428/32.25; 428/32.26; 428/32.27; 428/32.28; 428/32.34

(58) Field of Classification Search
CPC ..... B41M 5/52; B41M 5/5254; B41M 5/506; B41M 5/5218; B41M 5/5236
USPC ..... 428/32.13, 32.24, 32.25, 32.26, 32.27, 428/32.28, 32.34
See application file for complete search history.

(56) References Cited

U.S. PATENT DOCUMENTS

| | | | | |
|---|---|---|---|---|
| 3,143,421 | A | 8/1964 | Nadeau et al. | |
| 3,767,448 | A | 10/1973 | Hutton | |
| 4,365,423 | A | 12/1982 | Arter et al. | |
| 5,639,589 | A * | 6/1997 | Bauer et al. | 430/532 |
| 5,795,708 | A | 8/1998 | Boutet | |
| 6,387,473 | B1 | 5/2002 | Sismondi et al. | |
| 6,555,301 | B2 | 4/2003 | Smith et al. | |
| 6,630,283 | B1 | 10/2003 | Simpson et al. | |
| 2001/0014381 | A1 * | 8/2001 | Kaneko et al. | 428/195 |
| 2001/0022663 | A1 * | 9/2001 | Ishikawa et al. | 358/1.9 |
| 2002/0182380 | A1 | 12/2002 | Nagashima et al. | |
| 2002/0192436 | A1 * | 12/2002 | Voeght et al. | 428/195 |
| 2003/0039929 | A1 * | 2/2003 | Smith et al. | 430/434 |
| 2004/0063023 | A1 * | 4/2004 | Rao et al. | 430/201 |
| 2008/0057232 | A1 | 3/2008 | Leon et al. | |
| 2010/0260939 | A1 * | 10/2010 | Foley | 427/385.5 |

FOREIGN PATENT DOCUMENTS

| | | |
|---|---|---|
| EP | 1 346 840 | 9/2003 |
| WO | WO 2006/003390 | 1/2006 |

OTHER PUBLICATIONS

International Search Report mailed Dec. 28, 2011 for International Application No. PCT/US2011/054833, 2 pages.

Commonly Assigned U.S. Appl. No. 13/176,788, "Transparent Ink-Jet Recording Films, Compositions, and Methods," by Simpson et al., filed Jul. 6, 2011.

Commonly Assigned U.S. Appl. No. 13/208,379, "Transparent Ink-Jet Recording Films, Compositions, and Methods" by Simpson et al., filed Aug. 12, 2011.

*Research Disclosure*, No. 308119, Dec. 1989, pp. 46, (available from Research Disclosure, 145 Main St., Ossining, NY, 10562).

US Office Action dated Apr. 10, 2013 for U.S. Appl. No. 13/245,933, Sharon M. Simpson, et al., 11 pages.

US Office Action dated Feb. 14, 2013 for U.S. Appl. No. 13/309,614, Sharon M. Simpson, et al., 8 pages.

* cited by examiner

*Primary Examiner* — Betelhem Shewareged

(74) *Attorney, Agent, or Firm* — Reed L. Christiansen

(57) ABSTRACT

Transparent ink-jet recording films, compositions, and methods are disclosed. These compositions and methods can impart excellent adhesion properties between film layers and the transparent support. These films are useful for medical imaging.

19 Claims, No Drawings

TRANSPARENT INK-JET RECORDING FILMS, COMPOSITIONS, AND METHODS

CROSS REFERENCE TO RELATED APPLICATIONS

This application claims the benefit of U.S. Provisional Application No. 61/391,255, filed Oct. 8, 2010, entitled TRANSPARENT INK-JET RECORDING FILMS, COMPOSITIONS, AND METHODS, which is hereby incorporated by reference in its entirety.

SUMMARY

Transparent ink jet recording films often employ one or more under-layers or image-receiving layers on one or both sides of a transparent support. For medical applications, it is important that these layers not easily peel off of the transparent support during the lifetime of the product. The compositions and methods of the present application can impart excellent adhesion properties between these layers and the transparent support.

At least some embodiments provide a transparent ink-jet recording film comprising a transparent substrate comprising a polyester; at least one subbing layer disposed on the transparent substrate, where the at least one subbing layer comprises gelatin and at least one polymeric matting agent; at least one under-layer disposed on the at least one subbing layer, where the at least one under-layer comprises at least one first water soluble or water dispersible polymer and at least one borate or borate derivative, where the at least one first water soluble or water dispersible polymer comprises at least one hydroxyl group; and at least one image-receiving layer disposed on the at least one subbing layer, where the at least one image-receiving layer comprises at least one second water soluble or water dispersible polymer and at least one inorganic particle, where the at least one second water soluble or water dispersible polymer comprises at least one hydroxyl group.

In some embodiments, the transparent ink-jet recording film further comprises at least one primer layer disposed between the transparent substrate and the at least one subbing layer, where the at least one primer layer comprises at least one latex polymer and at least one adhesion promoter. In at least some embodiments, the at least one adhesion promoter comprises resorcinol.

In at least some embodiments, the at least one polymeric matting agent may comprise recurring units comprising methyl methacrylate, the at least one borate or borate derivative may comprise sodium tetraborate decahydrate, the at least one first water soluble or water dispersible polymer may comprise poly(vinyl alcohol), the at least one second water soluble or water dispersible polymer may comprise poly(vinyl alcohol), the at least one inorganic particle may comprise a boehmite alumina, or the at least one image-receiving layer may comprise nitric acid.

These embodiments and other variations and modifications may be better understood from the detailed description, exemplary embodiments, examples, and claims that follow. Any embodiments provided are given only by way of illustrative example. Other desirable objectives and advantages inherently achieved may occur or become apparent to those skilled in the art. The invention is defined by the appended claims.

DETAILED DESCRIPTION

All publications, patents, and patent documents referred to in this document are incorporated by reference herein in their entirety, as though individually incorporated by reference.

This application claims the benefit of U.S. Provisional Application No. 61/391,255, filed Oct. 8, 2010, entitled TRANSPARENT INK-JET RECORDING FILMS, COMPOSITIONS, AND METHODS, which is hereby incorporated by reference in its entirety.

Introduction

An ink-jet recording film may comprise at least one image-receiving layer, which receives ink from an ink jet printer during printing, and a substrate or support, which may be opaque or transparent. An opaque support may be used in films that may be viewed using light reflected by a reflective backing, while a transparent support may be used in films that may be viewed using light transmitted through the film.

Transparent Ink-Jet Films

Transparent ink-jet recording films are known in the art. See, for example, U.S. patent application Ser. No. 13/176,788, "TRANSPARENT INK-JET RECORDING FILMS, COMPOSITIONS, AND METHODS," by Simpson et al., filed Jul. 6, 2011, and U.S. patent application Ser. No. 13/208,379, "TRANSPARENT INK-JET RECORDING FILMS, COMPOSITIONS, AND METHODS," by Simpson et al., filed Aug. 12, 2011, both of which are hereby incorporated by reference in their entirety.

Transparent ink-jet recording films may comprise one or more transparent substrates. In some embodiments, the film may comprise at least one primer layer coated upon the one or more transparent substrates and at least one subbing layer coated upon the at least one primer layer. In other embodiments, the film may comprise at least one subbing layer coated upon the one or more transparent substrates. In still other embodiments, the film may comprise at least one subbing layer coated upon both the at least one primer layer and the one or more transparent substrates.

Such ink-jet recording films may further comprise at least one under-layer coated upon the at least one subbing layer. Such an under-layer may optionally be dried before being further processed. The film may further comprise one or more image-receiving layers coated upon at least one under-layer. Such an image-receiving layer is generally dried after coating. The film may optionally further comprise additional layers, such as one or more backing layers or overcoat layers, as will be understood by those skilled in the art.

Transparent Substrate

Some embodiments provide transparent ink-jet films comprising transparent substrates. Such transparent substrates are generally capable of transmitting visible light without appreciable scattering or absorption. For example, such transparent substrates may allow transmission of at least about 80% of visible light, or of at least about 85% of visible light, or of at least about 90% of visible light, or of at least about 95% of visible light.

Transparent substrates may be flexible, transparent films made from polymeric materials, such as, for example, polyethylene terephthalate, polyethylene naphthalate, cellulose acetate, other cellulose esters, polyvinyl acetal, polyolefins, polycarbonates, polystyrenes, and the like. In some embodiments, polymeric materials exhibiting good dimensional stability may be used, such as, for example, polyethylene terephthalate, polyethylene naphthalate, other polyesters, or polycarbonates.

Other examples of transparent substrates are transparent, multilayer polymeric supports, such as those described in U.S. Pat. No. 6,630,283 to Simpson, et al., which is hereby incorporated by reference in its entirety. Still other examples of transparent supports are those comprising dichroic mirror layers, such as those described in U.S. Pat. No. 5,795,708 to Boutet, which is hereby incorporated by reference in its entirety.

Transparent substrates may optionally contain colorants, pigments, dyes, and the like, to provide various background colors and tones for the image. For example, a blue tinting dye is commonly used in some medical imaging applications. These and other components may optionally be included in the transparent substrate, as will be understood by those skilled in the art.

In some embodiments, the transparent substrate may be provided as a continuous or semi-continuous web, which travels past the various coating, drying, and cutting stations in a continuous or semi-continuous process.

Substrate Treatments

In some embodiments, the surface of the transparent substrate may be treated to improve adhesion to adjacent layers of the film. Such surface treatments may include, but are not limited to, chemical treatment, mechanical treatment, corona discharge, flame treatment, UV irradiation, radio-frequency treatment, glow discharge, plasma treatment, laser treatment, acid treatment, ozone oxidation, electron beam treatment, and the like. These and other such surface treatments are known to those of skill in the art.

Primer Layers

In some embodiments, one or more primer layers may be used to improve adhesion of the transparent substrate to other layers. Generally, such primer layers, when present, are adjacent to the substrate surface, with the other layers disposed on the primer layers. Primer layers may be used in combination with or in lieu of treatment of the substrate surface. In some embodiments, a primer layer may comprise a coating thickness of about 0.112 g/m$^2$ on a dry basis.

Such primer layers may comprise adhesion promoters, such as phenolic or naphtholic compounds substituted with one or more hydroxyl groups, including but not limited to, for example, phenol, resorcinol, orcinol, catechol, pyrogallol, 2,4-dinitrophenol, 2,4,6-trinitrophenol, 4-chororesorcinol, 2,4-dihydroxy toluene, 1,3-naphthalenediol, the sodium salt of 1-naphthol-4-sulfonic acid, o-fluorophenol, m-fluorophenol, p-fluorophenol, o-cresol, p-hydroxybenzotrifluoride, gallic acid, 1-naphthol, chlorophenol, hexyl resorcinol, chloromethylphenol, o-hydroxybenzotrifluoride, m-hydroxybenzotrifluoride, p-chloro-m-xylenol, and the like. Other examples of adhesion promoters include acrylic acid, benzyl alcohol, trichloroacetic acid, dichloroacetic acid, chloral hydrate, ethylene carbonate, and the like. These or other adhesion promoters may be used as a single adhesion promoter or as mixtures of two or more adhesion promoters.

Such primer layers may comprise one or more polymers. Often these include polymers of monomers having polar groups in the molecule such as carboxyl, carbonyl, hydroxy, sulfo, amino, amido, epoxy or acid anhydride groups, for example, acrylic acid, sodium acrylate, methacrylic acid, itaconic acid, crotonic acid, sorbic acid, itaconic anhydride, maleic anhydride, cinnamic acid, methyl vinyl ketone, hydroxyethyl acrylate, hydroxyethyl methacrylate, hydroxychloropropyl methacrylate, hydroxybutyl acrylate, vinylsulfonic acid, potassium vinylbenezensulfonate, acrylamide, N-methylamide, N-methylacrylamide, acryloylmorpholine, dimethylmethacrylamide, N-t-butylacrylamide, diacetonacrylamide, vinylpyrrolidone, glycidyl acrylate, or glycidyl methacrylate, or copolymers of the above monomers with other copolymerizable monomers. Additional examples are polymers of, for example, acrylic acid esters such as ethyl acrylate or butyl acrylate, methacrylic acid esters such as methyl methacrylate or ethyl methacrylate or copolymers of these monomers with other vinylic monomers; or copolymers of polycarboxylic acids such as itaconic acid, itaconic anhydride, maleic acid or maleic anhydride with vinylic monomers such as styrene, vinyl chloride, vinylidene chloride or butadiene, or trimers of these monomers with other ethylenically unsaturated monomers. Materials used in adhesion-promoting layers often comprise a copolymer containing a chloride group such as vinylidene chloride. In some embodiments, a terpolymer of monomers comprising about 83 wt % vinylidene chloride, about 15 wt % methyl acrylate, and about 2 wt % itaconic acid may be used, as described in U.S. Pat. No. 3,143,421 to Nadeau et al., which is hereby incorporated by reference in its entirety.

In some embodiments, the one or more polymers may be provided as a latex dispersion. Such a latex dispersion may be prepared by, for example, emulsion polymerization. In other embodiments, the one or polymers may be prepared by solution polymerization, followed by dispersion of the polymers in water to form a latex dispersion. Such polymers, when provided as a latex dispersion, may be referred to as latex polymers.

The one or more primer layer may optionally also comprise one or more surfactants, such as, for example, saponin. Such surfactants may be provided as part of one or more latex dispersions or may be provided in addition to any surfactants may be in such dispersions.

In some embodiments, the one or more primer layers may be applied to the transparent substrate prior to orientation of the substrate. Such orientation may comprise, for example, uniaxial or biaxial orientation at one or more temperatures above the glass transition temperature and below the melting temperature of the transparent substrate.

Subbing Layers

The one or more subbing layers may be applied to a transparent substrate or to one or more primer layers disposed on a transparent substrate. Generally, such subbing layers, when present, are adjacent to the one or more primer layers, when present, or are adjacent to the substrate surface, when the one or more primer layers are absent. In some embodiments, for example, where the one or more primer layers do not completely cover the substrate surface, the one or more subbing layer may be adjacent to both that substrate surface and to the one or more primer layers. In some embodiments, a subbing layer may comprise a coating thickness of about 0.143 g/m$^2$ on a dry basis.

In some embodiments, the one or more subbing layers may comprise gelatin, such as, for example, Regular Type IV bovine gelatin, alkali-treated gelatin, acid-treated gelatin, phthalate-modified gelatin, vinyl polymer-modified gelatin, acetylated gelatin, deionized gelatin, and the like.

Such subbing layers may comprise one or more polymers. In some embodiments, such polymers may comprise polymers of monomers comprising polar groups in the molecule such as carboxyl, carbonyl, hydroxy, sulfo, amino, amido, epoxy or acid anhydride groups, for example, acrylic acid, sodium acrylate, methacrylic acid, itaconic acid, crotonic acid, sorbic acid, itaconic anhydride, maleic anhydride, cinnamic acid, methyl vinyl ketone, hydroxyethyl acrylate, hydroxyethyl methacrylate, hydroxychloropropyl methacrylate, hydroxybutyl acrylate, vinylsulfonic acid, potassium vinylbenezensulfonate, acrylamide, N-methylamide, N-methylacrylamide, acryloylmorpholine, dimethylmethacrylamide, N-t-butylacrylamide, diacetonacrylamide, vinylpyrrolidone, glycidyl acrylate, or glycidyl methacrylate, or copolymers of the above monomers with other copolymerizable monomers. Additional examples are polymers of, for example, acrylic acid esters such as ethyl acrylate or butyl acrylate, methacrylic acid esters such as methyl methacrylate or ethyl methacrylate or copolymers of these monomers with other vinylic monomers; or copolymers of polycarboxylic acids such as itaconic acid, itaconic anhydride, maleic acid or maleic anhydride with vinylic monomers such as styrene, vinyl chloride, vinylidene chloride or butadiene, or trimers of these monomers with other ethylenically unsaturated monomers. In some embodiments, materials used in subbing layers comprise polymers of one or more monomers containing a chloride group such as vinylidene chloride. In some embodiments, subbing layers may comprise one or more polymers comprising one or more polymeric matting agents. Such polymeric matting agents are described in U.S. Pat. No. 6,555,301 to Smith et al., which is hereby incorporated by reference in its entirety.

Such subbing layers may comprise one of more hardeners or crosslinking agents. In some embodiments, such hardeners may include, for example, 1,2-bis(vinylsulfonylacetamido) ethane, bis(vinylsulfonyl)methane, bis(vinylsulfonylmethyl) ether, bis(vinylsulfonylethyl)ether, 1,3-bis(vinylsulfonyl) propane, 1,3-bis(vinylsulfonyl)-2-hydroxypropane, 1,1,-bis (vinylsulfonyl)ethylbenzenesulfonate sodium salt, 1,1,1-tris (vinylsulfonyl)ethane, tetrakis(vinylsulfonyl)methane, tris (acrylamido)hexahydro-s-triazine, copoly(acrolein-methacrylic acid), glycidyl ethers, acrylamides, dialdehydes, blocked dialdehydes, alpha-diketones, active esters, sulfonate esters, active halogen compounds, s-triazines, diazines, epoxides, formaldehydes, formaldehyde condensation products anhydrides, aziridines, active olefins, blocked active olefins, mixed function hardeners such as halogen-substituted aldehyde acids, vinyl sulfones containing other hardening functional groups, 2,3-dihydroxy-1,4-dioxane, potassium chrome alum, polymeric hardeners such as polymeric aldehydes, polymeric vinylsulfones, polymeric blocked vinyl sulfones and polymeric active halogens.

Such subbing layers may comprise one or more surfactants. In some embodiments, such surfactants may include, for example, anionic surface active agents such as alkali metal or ammonium salts of alcohol sulfuric acid of 8 to 18 carbon atoms; ethanolamine lauryl sulfate; ethylaminolauryl sulfate; alkali metal and ammonium salts of paraffin oil; alkali metal salts of aromatic sulfonic acid such as dodecane-1-sulfonic acid, octadiene-1-sulfonic acid or the like; alkali metal salts such as sodium isopropylbenzene-sulfate, sodium isobutylnaphthalenesulfate or the like; and alkali metal or ammonium salts of esters of sulfonated dicarboxylic acid such as sodium dioctylsulfosuccinate, disodium dioctadecylsulfosuccinate or the like; nonionic surface active agents such as saponin, sorbitan alkyl esters, polyethylene oxides, polyoxyethylene alkyl ethers or the like; cationic surface active agents such as octadecyl ammonium chloride, trimethyldosecyl ammonium chloride or the like; and high molecular surface active agents other than those above mentioned such as polyvinyl alcohol, partially saponified vinyl acetates, maleic acid containing copolymers, or the like.

Such subbing layers may be coated from, for example, aqueous mixes. In some embodiments, a portion of the water in such mixes may be replaced by one or more water miscible solvents. Such solvents may include, for example, ketones such as acetone or methyl ethyl ketone, alcohols such as ethanol, methanol, isopropanol, n-propanol, and butanol, and the like.

Polymeric Matting Agents

In some embodiments, one or more subbing layers may comprise one or more polymers comprising one or more polymeric matting agents. Such polymeric matting agents are described in U.S. Pat. No. 6,555,301 to Smith et al., which is hereby incorporated by reference in its entirety. Polymeric matting agents may have an average particle sizes from, for example, about 1.2 to about 3 micrometers and glass transition temperatures of, for example, at least about 135 C or of at least about 150° C., as indicated by, for example, the onset in the change of heat capacity as measured by differential scanning calorimetry at a scan rate of 20 C/min. In some embodiments, polymeric matting agents may comprise copolymers of (A) recurring units derived from one or more polyfunctional ethylenically unsaturated polymerizable acrylates or methacrylates, and (B) recurring units derived from one or more monofunctional ethylenically unsaturated polymerizable acrylates or methacrylates having only one polymerizable site. Such copolymers may have compositions comprising, for example, from about 10 to about 30 wt % of (A) recurring units and from about 70 to about 90 wt % of (B) recurring units. Such copolymers may have compositions comprising at least about 5 wt % (A) recurring units, or at least about 10 wt % (A) recurring units, or up to about 30 wt % (A) recurring units, or up to about 50 wt % (A) recurring units. Such copolymers may have compositions comprising at least about 50 wt % (B) recurring units, or at least about 70 wt % (B) recurring units, or up to about 90 wt % (B) recurring units or up to about 95 wt % (B) recurring units.

Ethylenically unsaturated monomers represented by (A) include ethylenically unsaturated polymerizable compounds that have two or more functional groups that can be polymerized or reacted to form crosslinking sites within the polymer matrix. Thus, such monomers are considered "polyfunctional" with respect to the moieties used for polymerization and crosslinking. Representative monomers of this type include but are not limited to, aromatic divinyl compounds (such as divinylbenzene, divinylnaphthalene, and derivatives thereof), diethylene carboxylate esters (that is, acrylate and methacrylates) and amides (such as ethylene glycol dimethacrylate, diethylene glycol dimethacrylate, triethylene glycol dimethacrylate, ethylene glycol diacrylate, diethylene glycol diacrylate, 1,6-hexanediol dimethacrylate, 1,6-hexanediol diacrylate, pentaerythritol tetraacrylate, neopentyl glycol dimethacrylate, allyl methacrylate, allyl acrylate, butenyl acrylate, undecenyl methacrylate, 1,4-butanediol dimethacrylate, trimethylol propane trimethacrylate, trimethylol propane triacylate, 1,3-dibutanediol dimethacrylate, methylene-bisacrylamide, and hexamethylene-bisacrylamide), dienes (such as butadiene and isoprene), other divinyl compounds such as divinyl sulfide and divinyl sulfone compounds, and other compounds that would be readily apparent to one skilled in the art. Two or more of these monomers can be used to prepare matting agents. The polyfunctional acrylates and methacrylates described above are preferred in the practice of this invention. Ethylene glycol dimethacrylate, 1,6-hexanediol dimethacrylate, 1,6-hexanediol diacrylate, trimethylol propane trimethacrylate, and trimethylol propane triacrylate are particularly preferred. Ethylene glycol dimethacrylate is most preferred.

Ethylenically unsaturated monomers represented by (B) include polymerizable compounds that only one functional group that can be polymerized or reacted to form crosslinking sites within the polymer matrix. These include any other known monomer that can be polymerized in suspension polymerization with the monomers defined by the (A) recurring units. Such monomers include but are not limited to, ethylenically unsaturated hydrocarbons (such as ethylene, propylene, 1-butene, isobutene, styrene, α-methylstyrene, m-chloromethylstyrene, vinyl toluene, vinyl naphthalene, p-methoxystyrene, and hydroxymethylstyrene), ethylenically unsaturated esters of carboxylic acids (such as vinyl acetate, vinyl propionate, vinyl benzoate, vinyl cinnamate, and vinyl butyrate), esters of ethylenically unsaturated mono- or dicarboxylic acid amides (such as acrylamide, methacrylamide, N-methylacrylamide, N-ethylacrylamide, N,N-dimethylacrylamide, N-n-butylacrylamide, N-t-butylacrylamide, itaconic acid diamide, acrylamido-2,2-dimethylpropanesulfonic acid, N-isopropylacrylamide, N-acryloylmorpholine, and N-acryloylpiperidine), monoethylenically unsaturated dicarboxylic acids and their salts (such as acrylic acid, methacrylic acid, itaconic acid, and their salts), monoethylenically unsaturated compounds such as acrylonitrile and methacrylonitrile, vinyl halides (such as vinyl chloride, vinyl fluoride, and vinyl bromide), vinyl ethers (such as vinyl methyl ether, vinyl isobutyl ether, and vinyl ethyl ether), vinyl ketones (such as vinyl methyl ketone, vinyl hexyl ketone, and methyl isopropenyl ketone), acrolein, vinylidene halides (such as vinylidene chloride and vinylidene chlorofluoride), N-vinyl compounds (such as N-vinyl pyrrolidone, N-vinyl pyrrole, N-vinyl carbazole, and N-vinyl indole), and alkyl or aryl esters, amides, and nitriles (that is acrylates and methacrylates, such as methyl methacrylate, methyl acrylate, ethyl methacrylate, ethyl acrylate, n-butyl methacrylate, isobutyl methacrylate, 2-hydroxyethyl acrylate, 2-hydroxyethyl methacrylate, hexyl acrylate, hexyl methacrylate, 2-ethylhexyl acrylate, nonyl methacrylate, benzyl methacrylate, 2-hydroxypropyl methacrylate, and amides and nitriles of the same acids), and other compounds that would be understood to one skilled in the art. Mixtures of such monomers can also be used. Acrylates and methacrylates are preferred monomers for obtaining the (B) recurring units. Methyl methacrylate, isobutyl methacrylate, and methyl acrylate are particularly preferred and methyl methacrylate is most preferred.

In some embodiments, polymeric matting agents are prepared using one or more polyfunctional acrylates or methacrylates and one or more monofunctional acrylates or methacrylates. Representative useful polymers are as follows (having weight ratios within the previously described ranges): poly(methyl methacrylate-co-ethylene glycol dimethacrylate), poly(methyl methacrylate-co-1,6-hexanediol diacrylate), poly(methyl acrylate-co-trimethylol propane triacrylate), poly(isobutyl methacrylate-co-ethylene glycol dimethacrylate), and poly(methyl acrylate-co-1,6-hexanediol diacrylate).

Under-Layer Coating Mix

Under-layers may be formed by applying at least one under-layer coating mix to one or more of the subbing layers, primer layers, or transparent substrate. The under-layer coating mix may comprise at least one water soluble or dispersible cross-linkable polymer comprising at least one hydroxyl group, such as, for example, poly(vinyl alcohol), partially hydrolyzed poly(vinyl acetate/vinyl alcohol), copolymers containing hydroxyethylmethacrylate, copolymers containing hydroxyethylacrylate, copolymers containing hydroxypropylmethacrylate, hydroxy cellulose ethers, such as, for example, hydroxyethylcellulose, and the like. More than one type of water soluble or water dispersible cross-linkable polymer may optionally be included in the under-layer coating mix. In some embodiments, the water soluble or water dispersible polymer may be used in an amount of, for example, from about 0.25 to about 2.0 g/m$^2$, or from about 0.02 to about 1.8 g/m$^2$, as measured in the under-layer.

The under-layer coating mix may also optionally comprise at least one borate or borate derivative, such as, for example, sodium borate, sodium tetraborate, sodium tetraborate decahydrate, boric acid, phenyl boronic acid, butyl boronic acid, and the like. More than one type of borate or borate derivative may optionally be included in the under-layer coating mix. In some embodiments, the borate or borate derivative may be used in an amount of up to about 2 g/m$^2$. In at least some embodiments, the ratio of the at least one borate or borate derivative to the at least one water soluble or water dispersible polymer may be, for example, between about 25:75 and about 90:10 by weight, or the ratio may be about 66:33 by weight.

The under-layer coating mix may also optionally comprise other components, such as surfactants, such as, for example, nonyl phenol, glycidyl polyether. In some embodiments, such a surfactant may be used in amount from about 0.001 to about 0.60 g/m$^2$, as measured in the under-layer. In some embodiments, the under-layer coating mix may optionally further comprise a thickener, such as, for example, a sulfonated polystyrene. These and other optional mix components will be understood by those skilled in the art.

Image-Receiving Layer Coating Mix

Image-receiving layers may be formed by applying at least one image-receiving layer coating mix to one or more under-layer coatings. The image-receiving layer formed may, in some cases, comprise at least about 40 g/m$^2$ solids on a dry basis, or at least about 41.3 g/m$^2$ solids on a dry basis, or at least about 45 g/m$^2$ solids on a dry basis, or at least about 46 g/m$^2$ solids on a dry basis, or at least about 49 g/m$^2$ solids on a dry basis. The image-receiving coating mix may comprise at least one water soluble or dispersible cross-linkable polymer comprising at least one hydroxyl group, such as, for example, poly(vinyl alcohol), partially hydrolyzed poly(vinyl acetate/vinyl alcohol), copolymers containing hydroxyethylmethacrylate, copolymers containing hydroxyethylacrylate, copolymers containing hydroxypropylmethacrylate, hydroxy cellulose ethers, such as, for example, hydroxyethylcellulose, and the like. More than one type of water soluble or water dispersible cross-linkable polymer may optionally be included in the under-layer coating mix. In some embodiments, the at least one water soluble or water dispersible polymer may be used in an amount of up to about 1.0 to about 4.5 g/m$^2$, as measured in the image-receiving layer.

The image-receiving layer coating mix may also comprise at least one inorganic particle, such as, for example, metal oxides, hydrated metal oxides, boehmite alumina, clay, calcined clay, calcium carbonate, aluminosilicates, zeolites, barium sulfate, and the like. Non-limiting examples of inorganic particles include silica, alumina, zirconia, and titania. Other non-limiting examples of inorganic particles include fumed silica, fumed alumina, and colloidal silica. In some embodiments, fumed silica or fumed alumina have primary particle sizes up to about 50 nm in diameter, with aggregates being less than about 300 nm in diameter, for example, aggregates of about 160 nm in diameter. In some embodiments, colloidal silica or boehmite alumina have particle size less than about 15 nm in diameter, such as, for example, 14 nm in diameter. More than one type of inorganic particle may optionally be included in the image-receiving coating mix.

In at least some embodiments, the ratio of inorganic particles to polymer in the at least one image-receiving layer coating mix may be, for example, between about 88:12 and about 95:5 by weight, or the ratio may be about 92:8 by weight.

Image-receiving layer coating layer mixes prepared from alumina mixes with higher solids fractions can perform well in this application. However, high solids alumina mixes can, in general, become too viscous to be processed. It has been discovered that suitable alumina mixes can be prepared at, for example, 25 wt % or 30 wt % solids, where such mixes comprise alumina, nitric acid, and water, and where such mixes comprise a pH below about 3.09, or below about 2.73, or between about 2.17 and about 2.73. During preparation, such alumina mixes may optionally be heated, for example, to 80 C.

The image-receiving coating layer mix may also comprise one or more surfactants such as, for example, a nonyl phenol, glycidyl polyether; a fluoroacrylic alcohol substituted polyethylene; a hydroxy-terminated fluorinated polyether; or a non-ionic fluorosurfactant. In some embodiments, such a surfactant may be used in amount of, for example, about 1.5 $g/m^2$, as measured in the image-receiving layer. In some embodiments, the image-receiving coating layer may also optionally comprise one or more acids, such as, for example, nitric acid.

These and components may optionally be included in the image-receiving coating layer mix, as will be understood by those skilled in the art.

Coating

The coated layers, such as, for example, primer layers, subbing layers, under-layers, or image-receiving layers, may be coated from mixes onto the transparent substrate. The various mixes may use the same or different solvents, such as, for example, water or organic solvents. Layers may be coated one at a time, or two or more layers may be coated simultaneously. For example, simultaneously with application of an under-layer coating mix to the support, an image-receiving layer may be applied to the wet under-layer using such methods as, for example, slide coating.

Layers may be coated using any suitable methods, including, for example, dip-coating, wound-wire rod coating, doctor blade coating, air knife coating, gravure roll coating, reverse-roll coating, slide coating, bead coating, extrusion coating, curtain coating, and the like. Examples of some coating methods are described in, for example, *Research Disclosure*, No. 308119, December 1989, pp. 1007-08, (available from Research Disclosure, 145 Main St., Ossining, N.Y., 10562, http://www.researchdisclosure.com), which is hereby incorporated by reference in its entirety.

Drying

Coated layers, such as, for example, primer layers, subbing layers, under-layers, or image-receiving layers, may be dried using a variety of known methods. Examples of some drying methods are described in, for example, *Research Disclosure*, No. 308119, December 1989, pp. 1007-08, (available from Research Disclosure, 145 Main St., Ossining, N.Y., 10562, http://www.researchdisclosure.com), which is hereby incorporated by reference in its entirety. In some embodiments, coating layers may be dried as they travel past one or more perforated plates through which a gas, such as, for example, air or nitrogen, passes. Such an impingement air dryer is described in U.S. Pat. No. 4,365,423 to Arter et al., which is incorporated by reference in its entirety. The perforated plates in such a dryer may comprise perforations, such as, for example, holes, slots, nozzles, and the like. The flow rate of gas through the perforated plates may be indicated by the differential gas pressure across the plates. The ability of the gas to remove water may be limited by its dew point, while its ability to remove organic solvents may be limited by the amount of such solvents in the gas, as will be understood by those skilled in the art.

EXEMPLARY EMBODIMENTS

U.S. Provisional Application No. 61/391,255, filed Oct. 8, 2010, entitled TRANSPARENT INK-JET RECORDING FILMS, COMPOSITIONS, AND METHODS, which is hereby incorporated by reference in its entirety, disclosed the following eight non-limiting exemplary embodiments:

A. A transparent ink-jet recording film comprising:

a transparent substrate comprising a polyester;

at least one subbing layer disposed on the transparent substrate, said at least one subbing layer comprising gelatin and at least one polymeric matting agent;

at least one under-layer disposed on the at least one subbing layer, said at least one under-layer comprising at least one first water soluble or water dispersible polymer and at least one borate or borate derivative, said at least one first water soluble or water dispersible polymer comprising at least one hydroxyl group; and at least one image-receiving layer disposed on the at least one under-layer, said at least one image-receiving layer comprising at least one second water soluble or water dispersible polymer and at least one inorganic particle, said at least one second water soluble or water dispersible polymer comprising at least one hydroxyl group.

B. The transparent ink-jet recording film according to embodiment A, further comprising at least one primer layer disposed between said transparent substrate and said at least one subbing layer, said at least one primer layer comprising at least one latex polymer and at least one adhesion promoter.

C. The transparent ink-jet recording film according to embodiment B, wherein the at least one adhesion promoter comprises resorcinol.

D. The transparent ink jet recording film according to embodiment A, wherein the at least one polymeric matting agent comprises a copolymer comprising recurring units comprising methyl methacrylate.

E. The transparent ink-jet recording film according to embodiment A, wherein the at least one borate or borate derivative comprises sodium tetraborate decahydrate.

F. The transparent ink-jet recording film according to embodiment A, wherein the at least one first water soluble or water dispersible polymer comprises poly(vinyl alcohol).

G. The transparent ink-jet recording film according to embodiment A, wherein the at least one second water soluble or water dispersible polymer comprises poly(vinyl alcohol).

H. The transparent ink-jet recording film according to embodiment A, wherein the at least one inorganic particle comprises a boehmite alumina.

EXAMPLES

Materials

Materials used in the examples were available from Aldrich Chemical Co., Milwaukee, unless otherwise specified.

Boehmite is an aluminum oxide hydroxide (γ-AlO(OH)).

Borax is sodium tetraborate decahydrate.

CELVOL® 203 is a poly(vinyl alcohol) that is 87-89% hydrolyzed, with 13,000-23,000 weight-average molecular weight. It is available from Sekisui Specialty Chemicals America, Dallas, Tex.

CELVOL® 540 is a poly(vinyl alcohol) that is 87-89.9% hydrolyzed, with 140,000-186,000 weight-average molecular weight. It is available from Sekisui Specialty Chemicals America, LLC, Dallas, Tex.

DISPERAL® HP-14 is a dispersible boehmite alumina powder with high porosity and a particle size of 14 nm. It is available from Sasol North America, Inc., Houston, Tex.

Gelatin is a Regular Type IV bovine gelatin. It is available as Catalog No. 8256786 from Eastman Gelatine Corporation, Peabody, Mass.

GOHSENOL® KH-20 is a poly(vinyl alcohol) that is 78.5-81.5% hydrolyzed. It is available from Nippon Gohsei.

Surfactant 10G is an aqueous solution of nonyl phenol, glycidyl polyether. It is available from Dixie Chemical Co., Houston, Tex.

WITCOBOND® W-240 is a 30% aqueous anionic dispersion of a polyester based aliphatic isocyanate having no free isocyanate (Chemtura, Middlebury, Conn.).

WITCOBOND® W-320 is a 35% aqueous nonionic dispersion of a polyether based aliphatic isocyanate having no free isocyanate (Chemtura, Middelbury, Conn.).

Methods

Adhesion of the layers of each coated film was evaluated by scribing a cross-hatched area on the coated side of the film with a razor blade and gently removing the debris with a lint-free cotton pad. Adhesive tape (#610 semi-transparent pressure-sensitive tape from 3M Company, St. Paul, Minn.) was then applied to the crosshatched area and smoothed with a rubber roller until there were no air bubbles between the tape and the coated film. The tape was then rapidly peeled off. The appearance of the coated film was given a score on a 0 to 5 scale: 5=edges of scribed cuts completely smooth; 4=flakes of coating detached at some intersections of scribed lines, with less than about 5% of the test area being affected; 3=flakes of coating detached along some edges and at some intersections of scribed lines, with about 5 to 15% of the test area being affected; 2=flakes of coating detached along some edges of scribed lines and on parts of the squares, with about 15 to 35% of the test area being affected; 1=coating detached along the edges of scribed lines in large ribbons, with more than about 35% of the test area being affected; 0=coating completely removed.

Example 1

Preparation of Coated Substrate

A first mix was prepared with the composition: 73.2 wt % water; 24.2 wt % terpolymer of monomers comprising about 83 wt % vinylidene chloride, about 15 wt % methyl acrylate, and about 2 wt % itaconic acid; 1.6 wt % of a 65.4% aqueous solution of saponin; and 1 wt % resorcinol. This first mix was applied at 50° C. to a blue-tinted polyethylene terephthalate web, which was then dried and stretched. The resulting primer layer had a dry coating weight of 0.112 g/m$^2$ on a dry basis.

A second mix was prepared comprising: 98.74 wt % water; 0.16 wt % potassium acetate; 0.084 wt % gelatin; 0.0011 wt % saponin; 0.00075 wt % poly(methyl methacrylate-co-ethylene glycol dimethacrylate); and 0.000006 wt % chrome alum. This second mix was applied at 50° C. to the primer coated polyethylene terephthalate. The resulting subbing layer had a dry coating weight of 0.143 g/m$^2$ on a dry basis.

This coated substrate was cut into smaller coated films for lab coating experiments.

Preparation of Under-Layer Coated Substrate

A nominal 15 wt % polymer mix was first made. 37.5 g of poly(vinyl alcohol) (CELVOL® 203, Sekisui) was added over ten minutes to 212.5 g deionized water, which was agitated at room temperature. The agitated mixture was heated to 85 C and held for 30 min The agitated mixture was cooled. After returning to room temperature, approximately 1.5 g of deionized water was added to make up for water lost to evaporation. The polymer mix was held for gas bubble disengagement prior to use.

The coated substrate was knife-coated with a mixture of 0.88 g of the polymer mix, 5.28 g of a 5 wt % borax solution, and 3.824 g of deionized water, using a wet coating gap of 2.5 mils. The resulting under-layer coating had 4 wt % solids and a weight ratio of borax to polymer of 66:33.

Evaluation of Adhesion Properties

The adhesion properties of the under-layer coated film were evaluated as described above. The results are shown in Table I. Adhesion properties were excellent.

Example 2

The procedure of Example 1 was replicated, using an under-layer coating gap of 3.5 mils. The adhesion properties of the under-layer coated film were evaluated as described above. The results are shown in Table I. Adhesion properties were excellent.

Example 3

Preparation of Under-Layer Coated Substrate

An under-layer coated substrate was prepared according to the procedure of Example 1.

Preparation of Image-Receiving Layer Coated Films

A nominal 10 wt % polymer mix was first made. 25 g of poly(vinyl alcohol) (CELVOL® 540, Sekisui) was added over ten minutes to 225 g deionized water, which was agitated at room temperature. The agitated mixture was heated to 85° C. and held for 30 min. The agitated mixture was cooled. After returning to room temperature, approximately 1.5 g of deionized water was added to make up for water lost to evaporation. The polymer mix was held for gas bubble disengagement prior to use.

A nominal 20 wt % alumina mix was prepared at room temperature by adding 140 g of alumina powder (DISPERAL® HP-14, Sasol) to 560 g of deionized water with agitation over 30 min. The pH of the mix was adjusted to 3.25 by adding 40 drops of a 67 wt % aqueous solution of nitric acid. The mix was heated to 80 C and stirred for 30 min. The mix was cooled to room temperature and held for gas bubble disengagement prior to use.

A nominal 18 wt % solids image-receiving coating mix was prepared at room temperature by introducing 7.13 g of the polymer solution into a mixing vessel and agitating. To this mix, 41.00 g of the alumina mix, 0.66 g of a 10 wt % aqueous solution of nonyl phenol, glycidyl polyether (Surfactant 10G, Dixie), and 1.00 g of deionized water were added. The resulting image-receiving layer coating mix had an inorganic particle to polymer weight ratio of 92:8. The nominal 18 wt % solids image-receiving layer coating mix was knife-coated at room temperature onto the under-layer coated substrate, using a coating gap of 12 mils. The coated films were dried at 85° C. for 14 min in a Blue M Oven.

Evaluation of Adhesion Properties

The adhesion properties of the image-receiving layer coated film were evaluated as described above. The results are shown in Table I. Adhesion properties were excellent.

Example 4

An image-receiving layer coated film was prepared according to the procedure of Example 3. The adhesion properties of the image-receiving layer coated film were evaluated as described above. The results are shown in Table I. Adhesion properties were excellent.

Example 5

An image-receiving layer coated film was prepared according to the procedure of Example 3, using an under-layer coating gap of 3.5 mils. The adhesion properties of the image-receiving layer coated film were evaluated as described above. The results are shown in Table I. Adhesion properties were excellent.

Example 6

An image-receiving layer coated film was prepared according to the procedure of Example 3, using an under-layer coating gap of 3.5 mils. The adhesion properties of the image-receiving layer coated film were evaluated as described above. The results are shown in Table I. Adhesion properties were excellent.

Example 7

An under-layer coated film was prepared according to the procedure of Example 1, using a clear polyethylene terephthalate substrate. The adhesion properties of the image-receiving layer coated film were evaluated as described above. The results are shown in Table I. Adhesion properties were excellent.

Example 8

An under-layer coated film was prepared according to the procedure of Example 2, using a clear polyethylene terephthalate substrate. The adhesion properties of the image-receiving layer coated film were evaluated as described above. The results are shown in Table I. Adhesion properties were excellent.

Example 9

An image-receiving layer coated film was prepared according to the procedure of Example 3, using a clear polyethylene terephthalate substrate. The adhesion properties of the image-receiving layer coated film were evaluated as described above. The results are shown in Table I. Adhesion properties were excellent.

Example 10

An image-receiving layer coated film was prepared according to the procedure of Example 4, using a clear polyethylene terephthalate substrate. The adhesion properties of the image-receiving layer coated film were evaluated as described above. The results are shown in Table I. Adhesion properties were excellent.

Example 11

An image-receiving layer coated film was prepared according to the procedure of Example 5, using a clear polyethylene terephthalate substrate. The adhesion properties of the image-receiving layer coated film were evaluated as described above. The results are shown in Table I. Adhesion properties were excellent.

Example 12

An image-receiving layer coated film was prepared according to the procedure of Example 6, using a clear polyethylene terephthalate substrate. The adhesion properties of the image-receiving layer coated film were evaluated as described above. The results are shown in Table I. Adhesion properties were excellent.

Example 13

A primer- and subbing-coated substrate was prepared according to the procedures of Example 1 and cut into smaller coated films for lab coating experiments.

A 20 wt % aqueous mixture of boehmite alumina was prepared by adding 120 parts DISPERAL® HP14 (Salsol) to 480 parts deionized water over the course of 15 min, while stirring. The pH was adjusted to 4.0 by adding concentrated nitric acid to the mixture. The mixture was heated to 80° C., cooled to room temperature, and water lost to evaporation was replaced.

A series of under-layer coating compositions (13-1, 13-2, 13-2, and 13-4) were prepared by mixing the alumina mix and aqueous polyurethane dispersions (either WITCOBOND® W-240 (Chemtura) or WITCOBOND®W-320 (Chemtura)) in various proportions, as shown in Table II. These coating compositions were then coated on the primer- and subbing-coated films, with various dry coating thicknesses, also shown in Table II.

A poly(vinyl alcohol)-based under-layer composition (13-5) was also prepared and coated on a primer- and subbing-coated film, using the alumina mix and GOHSENOL® KH-20 poly(vinyl alcohol) (Nippon Gohsei), with composition and dry coating thickness as shown in Table II.

All of the polyurethane-based under-layer coated films of Table II exhibited poor adhesion, with the coatings flaking off after about 24 hrs. However, the poly(vinyl alcohol)-based under-layer coated film showed good adhesion and no flaking after 24 hrs.

The invention has been described in detail with reference to particular embodiments, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

TABLE I

| ID | Image-Receiving Layer Present? | Under-Layer Coating Gap (mils) | Adhesion Value |
|---|---|---|---|
| 1 | No | 2.5 | 5 |
| 2 | No | 3.5 | 5 |
| 3 | Yes | 2.5 | 5 |
| 4 | Yes | 2.5 | 5 |
| 5 | Yes | 3.5 | 5 |
| 6 | Yes | 3.5 | 5 |
| 7 | No | 2.5 | 5 |
| 8 | No | 3.5 | 5 |
| 9 | Yes | 2.5 | 5 |
| 10 | Yes | 2.5 | 5 |
| 11 | Yes | 3.5 | 5 |
| 12 | Yes | 3.5 | 5 |

TABLE II

| ID | Polymer | Alumina to Polymer Weight Ratio | Dry Coating Thickness (μm) | Adhesion Quality |
|---|---|---|---|---|
| 13-1 | W-320 | 80:20 | 25 | Very Poor |
| 13-2 | W-320 | 85:15 | 24 | Very Poor |
| 13-3 | W-320 | 90:10 | 25 | Very Poor |

TABLE II-continued

| ID | Polymer | Alumina to Polymer Weight Ratio | Dry Coating Thickness (μm) | Adhesion Quality |
|---|---|---|---|---|
| 13-4 | W-240 | 95:5 | 30 | Very Poor |
| 13-5 | PVA | 90:10 | 30 | Good |

The invention claimed is:

1. A transparent ink-jet recording film comprising:

a transparent substrate comprising a polyester;

at least one subbing layer disposed on the transparent substrate, said at least one subbing layer comprising gelatin and at least one polymeric matting agent, said at least one polymeric matting agent comprising a copolymer comprising first recurring units comprising methyl methacrylate and second recurring units comprising ethylene glycol dimethacrylate;

at least one under-layer disposed on the at least one subbing layer, said at least one under-layer comprising at least one first water soluble or water dispersible polymer and at least one borate or borate derivative, said at least one first water soluble or water dispersible polymer comprising at least one hydroxyl group; and at least one image-receiving layer disposed on the at least one under-layer, said at least one image-receiving layer comprising at least one second water soluble or water dispersible polymer and at least one inorganic particle, said at least one second water soluble or water dispersible polymer comprising at least one hydroxyl group.

2. The transparent ink jet recording film according to claim 1, further comprising at least one primer layer disposed between said transparent substrate and said at least one subbing layer, said at least one primer layer comprising at least one latex polymer and at least one adhesion promoter.

3. The transparent ink-jet recording film according to claim 2, wherein the at least one adhesion promoter comprises resorcinol.

4. The transparent ink jet recording film according to claim 1, wherein the at least one borate or borate derivative comprises sodium tetraborate decahydrate.

5. The transparent ink-jet recording film according to claim 1, wherein the at least one first water soluble or water dispersible polymer comprises poly(vinyl alcohol).

6. The transparent ink-jet recording film according to claim 1, wherein the at least one second water soluble or water dispersible polymer comprises poly(vinyl alcohol).

7. The transparent ink jet recording film according to claim 1, wherein the at least one inorganic particle comprises a boehmite alumina.

8. The transparent ink-jet recording film according to claim 1, wherein the at least one image-receiving layer comprises nitric acid.

9. A transparent ink-jet recording film comprising:

a transparent substrate comprising a polyester;

at least one subbing layer disposed on the transparent substrate, said at least one subbing layer comprising gelatin and at least one polymeric matting agent, said at least one polymeric matting agent comprising at least one copolymer comprising at least one first recurring unit and at least one second recurring unit, said at least one first recurring unit comprising recurring units derived from at least one diethylene carboxylate ester, and said at least one second recurring unit comprising recurring units derived from one or more monofunctional ethylenically unsaturated polymerizable acrylates or methacrylates having only one polymerizable site;

at least one under-layer disposed on the at least one subbing layer, said at least one under-layer comprising at least one first water soluble or water dispersible polymer and at least one borate or borate derivative, said at least one first water soluble or water dispersible polymer comprising at least one hydroxyl group; and at least one image-receiving layer disposed on the at least one under-layer, said at least one image-receiving layer comprising at least one second water soluble or water dispersible polymer and at least one inorganic particle, said at least one second water soluble or water dispersible polymer comprising at least one hydroxyl group.

10. The transparent ink-jet recording film according to claim 9, wherein the at least one first recurring unit is derived from ethylene glycol dimethacrylate.

11. The transparent ink jet recording film according to claim 9, wherein the at least one second recurring unit is derived from at least one acrylate or methacrylate.

12. The transparent ink-jet recording film according to claim 9, wherein the at least one second recurring unit is derived from methyl methacrylate.

13. The transparent ink-jet recording film according to claim 9, wherein the at least one first recurring unit is derived from ethylene glycol dimethacrylate and the at least one second recurring unit is derived from methyl methacrylate.

14. The transparent ink-jet recording film according to claim 9, wherein the at least one copolymer comprises at least about 5 wt % of the at least one first recurring unit and up to about 95 wt % of the at least one second recurring unit.

15. The transparent ink-jet recording film according to claim 9, wherein the at least one copolymer comprises at least about 10 wt % of the at least one first recurring unit and up to about 90 wt % of the at least one second recurring unit.

16. The transparent ink-jet recording film according to claim 9, wherein the at least one copolymer comprises up to about 50 wt % of the at least one first recurring unit and at least about 50 wt % of the at least one second recurring unit.

17. The transparent ink jet recording film according to claim 9, wherein the at least one copolymer comprises from about 10 to about 30 wt % of the at least one first recurring unit and from about 70 to about 90 wt % of the at least one second recurring unit.

18. The transparent ink-jet recording film according to claim 1, wherein the copolymer exhibits a glass transition temperature of at least about 135° C.

19. The transparent ink-jet recording film according to claim 9, wherein the copolymer exhibits a glass transition temperature of at least about 135° C.

* * * * *